United States Patent [19]

Batchelor

[11] Patent Number: 4,553,282

[45] Date of Patent: Nov. 19, 1985

[54] MOP HEAD

[75] Inventor: Douglas R. Batchelor, Chicago, Ill.

[73] Assignee: Libman Broom Company, Arcola, Ill.

[21] Appl. No.: 691,744

[22] Filed: Jan. 15, 1985

[51] Int. Cl.[4] ..... A47L 13/258

[52] U.S. Cl. ..... 15/150; 15/229 A

[58] Field of Search ..... 15/146, 147 R, 147 C, 15/150, 228, 229 A, 229 B

[56] References Cited

U.S. PATENT DOCUMENTS

| | | | |
|---|---|---|---|
| 659,918 | 10/1900 | Froberg | 15/150 |
| 2,209,635 | 7/1940 | Raittila | 15/150 |
| 3,187,363 | 6/1965 | Auwarter | 15/150 X |
| 4,287,632 | 9/1981 | Hammond | 15/150 |

*Primary Examiner*—Edward L. Roberts

*Attorney, Agent, or Firm*—Marshall, O'Toole, Gerstein, Murray & Bicknell

[57] ABSTRACT

A mop head of polymeric material having a hood, to be placed on a handle end, and a bendable mop retaining bar, integrally joined at one end to an end of the hood and having a flexible finger at the other end. The finger terminates in an enlarged portion which releasably engages the hood through an opening in the hood to lock the bar in place and thereby secure the mop on the mop head.

4 Claims, 5 Drawing Figures

FIG. 1
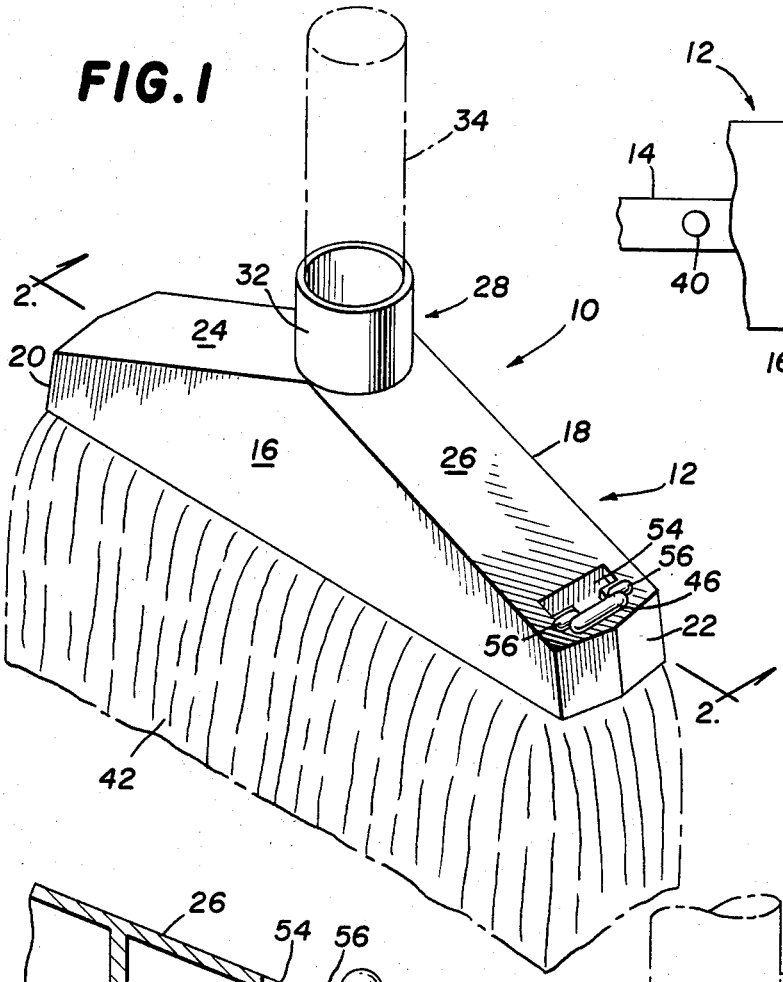
FIG. 4
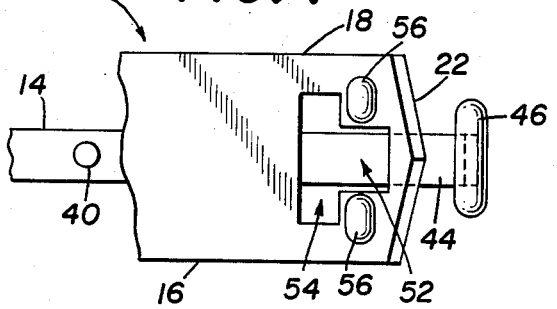
FIG. 5
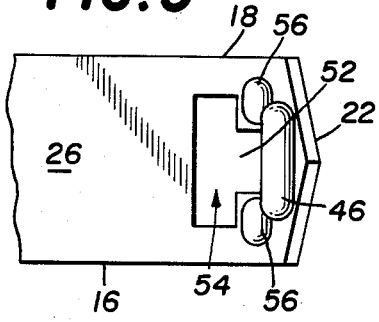
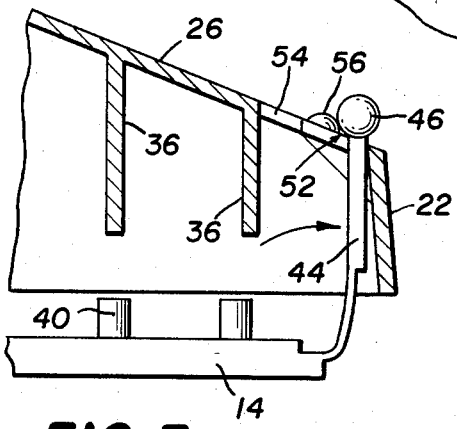
FIG. 3
FIG. 2
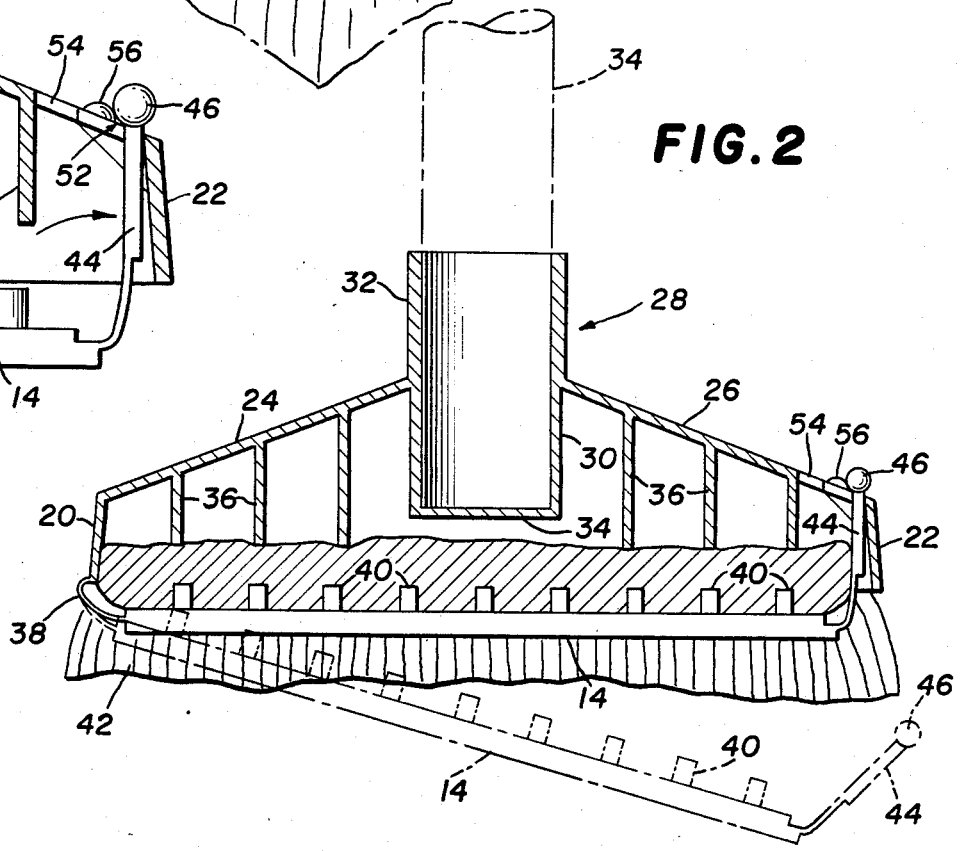

MOP HEAD

This invention relates to mops used domestically in homes, offices, recreation vehicles and boats. More particularly, this invention concerns a mop head of polymeric material having a locking mechanism for releasably securing a mop thereto.

BACKGROUND OF THE INVENTION

Mops are widely used domestically to clean floors of homes, offices, recreation vehicles and boats. Usually, domestic mops are inexpensive items, as distinguished from industrial mops which must be more rugged because of the hard use to which they are put.

One type of domestic mop has a handle with a mop head, at one end, designed to hold a mop of cotton threads or strings. Auwarter U.S. Pat. No. 3,187,363 and Oas U.S. Pat. No. 3,457,581 disclose domestic mops with mop heads made of polymeric material.

The mop head disclosed in the Oas U.S. Pat. No. 3,457,581, has a polymeric hood and a mop retaining bar bendably joined integrally at one end to an end wall of the hood. The other end of the bar terminates in a bendable portion with a ball end. The adjoining end wall of the hood has a vertical slot through which this bendable portion can be moved to position the ball in a recess on the hood top wall. In this manner it is intended to lock a mop, located on the retaining bar, in place. However, the described structure has several undesirable features. Thus, the end wall is not continuous since the vertical slot divides it in half, thereby reducing its strength. More importantly, when a cotton mop is in place, it applies an outward force to the bendable portion having the ball. This force can release the ball from its recess position and move the bendable portion out of the slot so that the mop retaining bar becomes unlocked. The mop will then be freed and come loose upon further handling, especially when dipped in water.

From the above it is clear that an improved mop head and locking arrangement are needed.

SUMMARY OF THE INVENTION

According to the invention a mop head is provided comprising a hood of polymeric material; the hood having front and rear spaced apart substantially vertical walls, lateral end walls connected to the front and rear walls, and a top wall connected to the front, rear and end walls; a handle end-receiving tubular member integral with the hood and extending downwardly below the top wall between the front and rear walls and extending above the top wall; a mop retaining bar; means connecting a first end of the bar to the hood at one end wall; the second end of the mop retaining bar having a projecting finger, which is bendable, connected thereto; the finger having an enlarged head at the end; the hood top wall having a finger end receiving opening adjacent the hood end wall closest to the finger; the opening in the top wall having first and second adjoining portions in communication with each other and with the first portion being adjacent the end wall and the second portion inward therefrom; the opening first portion having a width which permits the finger to move freely therein but which is less than the width of the finger enlarged head; and the opening second portion having a size to permit passage therethrough of the finger enlarged head; whereby a mop means can be installed between the bar and the hood bottom and the finger, the finger then locked in place by feeding the finger enlarged head through the opening second portion from beneath the top wall to slightly thereabove and then moving the finger to position it in the opening first portion with the enlarged head bearing on and supported by the top wall along the edge of the opening first portion.

The enlarged end of the finger can constitute a crossbar at the end thereby giving the end portion of the finger a T-shape. Additionally, the opening first and second portions together can form a T-shaped opening adjacent the hood end wall closest to the finger. The opening first portion can have a width which permits the finger to move freely therein but which is less than the width of the finger crossbar and the opening second portion can have a size to permit passage therethrough of the finger crossbar. With such an arrangement, a mop means, such as a cotton or sponge mop, can be installed on the head between the bar and the hood bottom and the finger then locked in place by feeding the finger crossbar through the T-shaped opening second portion from beneath the top wall to slightly thereabove and then moving the finger to position it in the T-shaped opening first portion with the crossbar ends bearing on and supported by the top wall along the edge of the opening first portion.

The retaining bar desirably is integral with the hood and made of the same polymeric material.

The retaining bar end containing the finger can be made sufficiently long to extend to at least beneath the opening second portion so as to have an inherent springy action of the finger move it into the opening first portion so that retraction of the finger out of the opening is automatically resisted.

The hood top wall is generally provided with ridge means adjacent the opening first portion against which the enlarged head abutts to resist movement of the finger out of the opening first portion into the opening second portion.

BRIEF DESCRIPTION OF THE DRAWINGS

FIG. 1 is an isometric view of a mop head according to the invention, including a handle in phantom and a cotton mop;

FIG. 2 is a partial sectional view taken along the line 2—2 of FIG. 1;

FIG. 3 is an enlarged partial sectional view of that portion of the retaining bar having the finger end locked to the hood;

FIG. 4 is a plan view of the end of the hood and the retaining bar and finger end in unlocked position; and FIG. 5 is similar to FIG. 4 but with the finger locked in position to the hood.

DETAILED DESCRIPTION OF THE DRAWINGS

To the extent it is reasonable and practical, the same elements or parts illustrated in the various views of the drawings will be identified by the same numbers.

With reference to the drawings, the mop head 10 has a hood 12 and a mop retaining bar 14. The hood 12 has identical front and rear spaced apart substantially vertical walls 16, 18 and lateral end walls 20, 22 connected to the front and rear walls. A top wall comprising two portions 24, 26 is connected to the top edges of the front, rear and end walls 16, 18, 20, 22. A handle end-receiving tubular member 28, integral with the hood, has a lower part 30 extending downwardly below the top wall portions 24, 26 between the front and rear walls 16, 18 and also an upper part 32 extending upwardly, or above, the hood top wall portions. Handle 34 is shown in phantom extending into the tubular member 28, which has a lower end wall 34 which limits penetration of the handle end therein.

A plurality of vertical spaced apart stiffening ribs 36 extend laterally between, and are connected to, the front and rear walls 16, 18. The ribs are also connected to top wall portions 24, 26. The lower ends of the ribs 36 terminate in a common plane located inward, or above, the lower edges of front and rear walls 16, 18 and ends walls 20, 22, the latter also desirably terminating in a common plane.

The mop retaining bar 14 has a bendable integral section 38 which interconnects integrally with the lower part of end wall 20. The bar is molded as an integral element with hood 12.

A series of prongs 40 are aligned in spaced apart arrangement on the upper surface of retaining bar 14. The prongs 40 press into mop 42 and help to keep it from sliding on the bar.

The forward or distal end of retaining bar 14 has a projecting bendable finger 44 connected thereto. The finger is desirably molded as an integral part of the bar. The finger 44 terminates in an enlarged head which, in the embodiment shown in the drawings, constitutes a crossbar 46 which gives the finger end a T-shape.

A finger end receiving opening 48 is located in the hood top wall portion 26. The opening 48 is located adjacent the hood end wall 22 closest to the finger 44. The opening 48 has first 52 and second 54 adjoining portions in communication with each other. The opening first portion 52 is adjacent the continuous or undivided end wall and the opening second portion 54 is inward therefrom away from end wall 22.

The opening first portion 52 has a width which permits the finger 44 to move freely therein but which is less than the width of the finger enlarged head. The opening second portion has a size to permit passage therethrough of the finger enlarged head or crossbar 46.

The top wall portion 26 has a pair of ridges 56 adjacent the opening first portion against which the crossbar 46 abutts to resist movement of the finger out of the opening first portion 52 into the opening second portion 54.

To secure cotton mop 42 in position, it is draped over the top of retaining bar 14 so that approximately one-half of the mop hangs down each side of the bar. The mop when so arranged is intended to have its side edges in contact with bendable section 38 and finger 44. The finger 44 is then pushed upwardly behind the undivided end wall 22 so that the crossbar 46 can move through and above opening second portion 54 in top wall portion 26. The finger 44 is then moved, to a considerable extent because of the internal stress which develops when the finger is bent to move it upwardly and through the opening second portion 54, into the opening first portion 52. With the crossbar 46 located above the opening first portion 52, any remaining manual upward force on the bar and finger can be released. Since the cotton mop 42 at this stage is compressed between bar 14 and the bottom edges of ribs 36 the force thereby applied to the bar forces it downwardly, causing the finger to be pulled downwardly thus locking the crossbar 46 behind ribs 56. The crossbar ends bear on and are supported by the top wall along the edges of the opening first portion. The pressure of mop 42 against finger 44 when in the described locked stage also helps maintain the finger in outward locked position. However, since end wall 22 is undivided or continuous, the finger is prevented from moving any further outwardly, thus preventing unlocking as could occur in the mop head of Oas U.S. Pat. No. 3,457,581.

To remove cotton mop 42, the finger 44 can be displaced manually by reversing the described procedure.

Instead of installing a cotton mop 42 as described, a mop made wholly or partly of other natural, or even synthetic fibers, can be put in place as described. It is also feasible to install a sponge between the retaining bar 14 and hood 12 and use it for mopping purposes.

The mop head can be injection molded from a suitable polymeric material such as high density polyethylene or from polypropylene.

The foregoing detailed description has been given for clearness of understanding only, and no unnecessary limitations should be understood therefrom, as modifications will be obvious to those skilled in the art.

What is claimed is:

1. A mop head comprising:

a hood of polymeric material;

the hood having front and rear spaced apart substantially vertical walls, lateral end walls connected to the front and rear walls, and a top wall connected to the front, rear and end walls;

a handle end-receiving tubular member integral with the hood and extending downwardly below the top wall between the front and rear walls and extending above the top wall;

a mop retaining bar;

means connecting a first end of the bar to the hood at one end wall;

the second end of the mop retaining bar having a projecting finger, which is bendable, connected thereto;

the finger having an enlarged head at the end;

the hood top wall having a finger end receiving opening adjacent the hood end wall closest to the finger;

the opening in the top wall having first and second adjoining portions in communication with each other and with the first portion being adjacent the end wall and the second portion inward therefrom;

the opening first portion having a width which permits the finger to move freely therein but which is less than the width of the finger enlarged head; and the opening second portion having a size to permit passage therethrough of the finger enlarged head;

whereby a mop means can be installed between the bar and the hood bottom and the finger, the finger then locked in place by feeding the finger enlarged head through the opening second portion from beneath the top wall to slightly thereabove and then moving the finger to position it in the opening first portion with the enlarged head bearing on and supported by the top wall along the edge of the opening first portion.

2. A mop head comprising:

a hood of polymeric material;

the hood having front and rear spaced apart substantially vertical walls, lateral end walls connected to the front and rear walls, and a top wall connected to the front, rear and end walls;

a handle end-receiving tubular member integral with the hood and extending downwardly below the top wall between the front and rear walls and extending above the top wall;

a mop retaining bar;

means connecting a first end of the bar to the hood at one end wall;

the second end of the mop retaining bar having a projecting finger, which is bendable, connected thereto;

the finger having a crossbar at the end thereby giving the end portion of the finger a T-shape;

the hood top wall having a finger end receiving T-shaped opening adjacent the hood end wall closest to the finger;

the opening in the top wall having first and second adjoining portions in communication with each other and with the first portion being adjacent the end wall and the second portion inward therefrom;

the opening first portion having a width which permits the finger to move freely therein but which is less than the width of the finger crossbar; and the opening second portion having a size to permit passage therethrough of the finger crossbar;

whereby a mop means can be installed on the head between the bar and the hood bottom and the finger then locked in place by feeding the finger crossbar through the T-shaped opening second portion from beneath the top wall to slightly thereabove and then moving the finger to position it in the T-shaped opening first portion with the crossbar ends bearing on and supported by the top wall along the edge of the opening first portion.

3. A mop head according to claim 1 in which:

the retaining bar is integral with the hood and made of the same polymeric material; and the retaining bar end containing the finger extends to at least beneath the opening second portion so as to have an inherent springy action of the finger move it into the opening first portion so that retraction of the finger out of the opening is automatically resisted.

4. A mop head according to claim 3 in which the top wall has ridge means adjacent the opening first portion against which the enlarged head abutts to resist movement of the finger out of the opening first portion into the opening second portion.

* * * * *